United States Patent [19]

Blair

[11] 4,085,868

[45] Apr. 25, 1978

[54] BATH OIL INJECTION DEVICE FOR SHOWER BATH

[76] Inventor: Robert Lynn Blair, Box 2515, Sarasota, Fla. 33578

[21] Appl. No.: 719,702

[22] Filed: Sep. 1, 1976

[51] Int. Cl.[2] ..... B05B 7/32

[52] U.S. Cl. ..... 222/193; 222/209; 239/315; 239/373

[58] Field of Search ..... 222/209, 401, 193; 239/310, 315, 316, 373

[56] References Cited

U.S. PATENT DOCUMENTS

| | | | |
|---|---|---|---|
| 2,853,207 | 9/1958 | Yingst | 222/209 X |
| 3,052,417 | 9/1962 | Daniel | 239/310 X |
| 3,091,402 | 5/1963 | Palmer | 239/315 |
| 3,612,404 | 10/1971 | Vicari | 239/310 |

*Primary Examiner*—Allen N. Knowles
*Assistant Examiner*—Frederick R. Handren

[57] ABSTRACT

A device with a coupling for attaching to a pipe conducting liquid to a shower bath, and a coupling for attaching a shower head thereto. Which device contains a reservoir for bath oil and compressed air, which compressed air forces bath oil through an inlet into the water stream, thus permitting bath oil to be completely comingled with bath water before reaching shower head. The compressed air is supplied by a hand squeezed air pump, and the above mentioned inlet is controlled by a valve.

1 Claim, 2 Drawing Figures

INVENTOR
ROBERT L. BLAIR

BATH OIL INJECTION DEVICE FOR SHOWER BATH

BACKGROUND OF THE INVENTION

1. Description of the Prior Art

Shower bath attachments that admix bath oil to the water stream are known. Shower baths which are provided with a device for admixing bath oil to the liquid spray are also known, but these devices are complicated to use, or lack means of complete control by the user of how much or how little bath oil is admixed to his shower bath water.

2. Summary of the Invention

One object of this invention is to provide a shower bath attachment that is easily attached to a shower pipe conducting liquid, with a provision for attaching a shower head to said device. The device contains a bath oil reservoir that holds enough bath oil for several normal shower baths. Once thus attached, it can very conveniently be filled with any liquid bath oil agent from any type of commercially known containers readily available from many stores throughout the United States.

Another object of this invention is to provide a convenient and controllable method of overcoming the back flow water pressure from the shower head in the water pipe near the shower head, and injecting bath oil into the shower water supply ahead of the shower head for complete comingling of the bath oil and the shower water. This is accomplished by a hand squeezed air pump, a compressed air reservoir, a check valve and a valve controlled inlet to the water stream of a shower bath. These items will be further explained in the detailed description of this application.

BRIEF DESCRIPTION OF THE DRAWING

The present invention will be described more in detail in connection with the attached drawings of which

In the drawings, like index numerals designate like parts of the device.

DETAILED DESCRIPTION OF THE PREFERRED EMBODIMENTS

Figure 1:
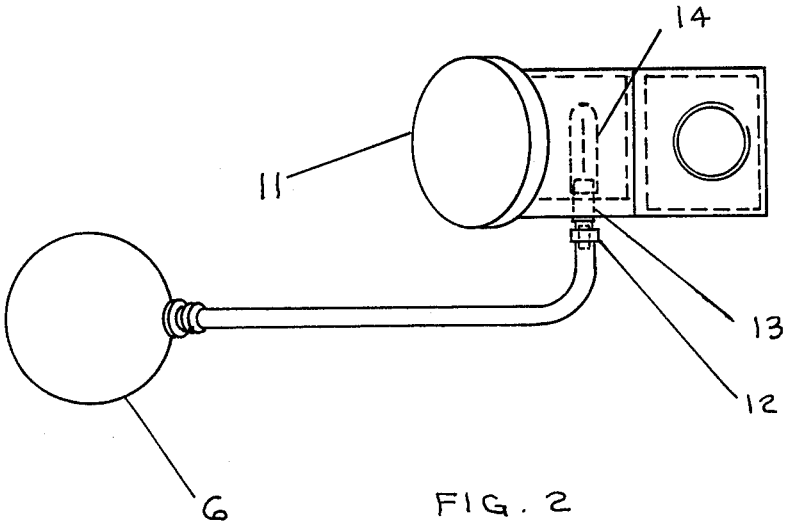
FIG. 1 illustrates a top view of the device primarily to show the check valve inside the compressed air reservoir, and means of how it is attached to unit.
Figure 2:
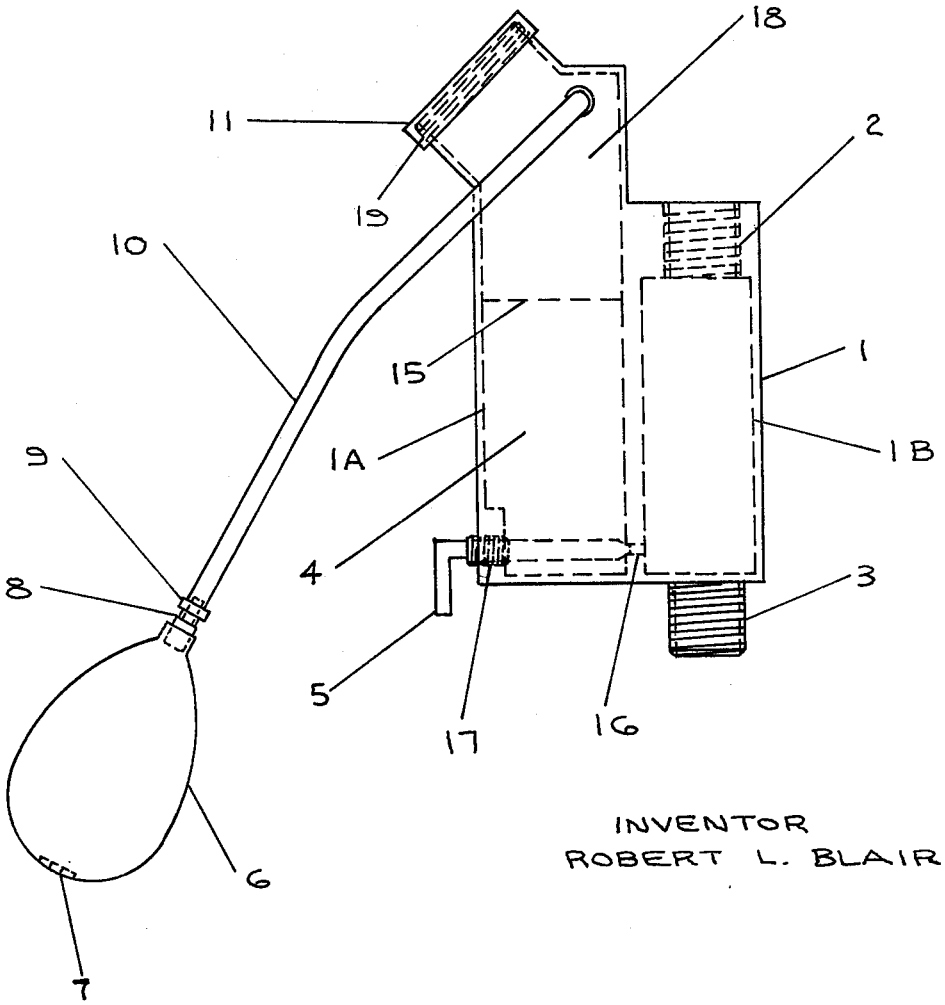
FIG. 2 illustrates a side view showing all the important embodiments of the device not shown in FIG. 1.

The device according to the present invention consists of a molded housing 1, molded from plastic or other like material which can be attached to a shower pipe conducting a liquid by threads 2, and to a shower head by threaded coupling 3. The device is made ready for use as follows: Threaded bath oil fill cap 11 is removed. Liquid bath oil is poured into opening until bath oil reaches oil level line 15. Cap 11 is then replaced. At this time hand squeezed air pump 6, which contains a ball check valve 7, is squeezed one time which develops compressed air in section 18, of reservoir 1A, applying a downward pressure on bath oil section 4, of reservoir 1A. Check valve 14, which is a slitted rubber device maintains air pressure in section 18, of reservoir 1A, until valve 5, is opened by means of thread 17, opening inlet 16, to allow bath oil to flow through inlet 16, into water flow channel 1B. Bath oil will continue to flow through inlet 16, into water flow channel 1B, until the back flow water pressure from shower head at inlet 16, is equal to the compressed air pressure in section 18, of reservoir 1A. At this time if user desires more bath oil (presumably in the rinse cycle of his shower) he need only squeeze air pump 6, every few seconds until desired results are obtained.

Plastic air hose 10, is of sufficient length to allow user to stand a normal distance from shower when operating this device. Air hose 10, is connected to air pump 6, by means of connector 8, held on by clamp 9, and connected to main body of device by connector 13, and clamp 12. Check valve 14, is also connected to one end of connector 13.

I claim as my invention:

1. A shower bath attachment comprising: a housing; a reservoir for liquid additive formed in the housing; a filling opening and an air inlet opening formed in the housing and leading from outside the housing to the reservoir; a closure cap for the filling opening; a one-way check valve positioned in the air inlet opening allowing air to enter the reservoir; an open-ended water flow passage formed in the housing; couplings at the upstream and downstream ends of the water flow passage for connection, respectively, to a shower supply pipe and a shower spray head; a liquid additive passage formed in the housing for conducting liquid additive from the reservoir to the water flow passage; a manually adjustable needle valve, accessible from outside the housing, positioned in the liquid additive passage for controlling the flow of liquid additive through the passage; a flexible conduit having one end connected at the exterior of the housing to the air inlet opening for introducing compressed air into the reservoir to urge liquid additive from the reservoir through the liquid additive passage into water flowing through the water flow passage; a manually compressible resilient bulb, including a one-way air inlet check valve and an air outlet, connected to the other end of the flexible conduit for developing compressed air to be introduced into the reservoir.

* * * * *